US006113054A

United States Patent [19]

Ma

[11] Patent Number: 6,113,054

[45] Date of Patent: Sep. 5, 2000

[54] UMBRELLA BASE HAVING ADJUSTABLE WEIGHTS

[76] Inventor: Oliver Joen-An Ma, 29 W. Wistaria Ave., Arcadia, Calif. 91006

[21] Appl. No.: 09/249,707

[22] Filed: Feb. 12, 1999

[51] Int. Cl.[7] ..... F16M 13/00

[52] U.S. Cl. ..... 248/523; 248/158; 248/910; 248/519

[58] Field of Search ..... 248/519, 523, 248/910, 524, 158, 535, 912, 123.2, 903; 135/16, 99, 98, 96, 20.3, 21, 25.1, 33.2, 15.1, 19, 14; 211/62

[56] References Cited

U.S. PATENT DOCUMENTS

| | | | |
|---|---|---|---|
| 3,119,588 | 1/1964 | Keats | 248/158 |
| 3,415,475 | 12/1968 | Goodman | 248/158 |
| 3,692,035 | 9/1972 | Houston | 135/25 |
| 4,099,771 | 7/1978 | Mathews | 297/217 |
| 4,148,455 | 4/1979 | Oliver | 248/524 |
| 4,222,546 | 9/1980 | Walker, Jr. | 248/676 |
| 4,232,846 | 11/1980 | Bressani | 248/158 |
| 4,591,126 | 5/1986 | Berney | 248/524 |
| 4,832,163 | 5/1989 | Levesque | 190/11 |
| 5,088,680 | 2/1992 | Farmer | 248/523 |
| 5,207,406 | 5/1993 | Stine et al. | 248/514 |
| 5,354,031 | 10/1994 | Bilotti | 248/519 |
| 5,497,972 | 3/1996 | Sofy | 248/523 |
| 5,961,091 | 10/1999 | Petryna et al. | 248/523 |

*Primary Examiner*—Ramon O. Ramirez
*Assistant Examiner*—Gwendolyn Baxter
*Attorney, Agent, or Firm*—Raymond Sun

[57] ABSTRACT

A patio umbrella base has a base housing that has a central opening, and an interior wall configured to define an interior space, with a shaft extending from the central opening. A first weight is secured to the interior wall of the base housing and retained inside the interior space, and a second weight is removably secured to the base housing and retained inside the interior space.

9 Claims, 3 Drawing Sheets

UMBRELLA BASE HAVING ADJUSTABLE WEIGHTS

BACKGROUND OF THE INVENTION

1. Field of the Invention

The present invention relates to outdoor and patio umbrellas, and in particular, to an umbrella base that is adapted for use in supporting outdoor and patio umbrellas.

2. Description of the Prior Art

Outdoor and patio umbrellas (hereinafter referred to collectively as patio umbrellas) have become increasingly popular in recent years as people have found new and useful applications for them. For example, patio umbrellas have traditionally been used at patios and backyards of homes to provide shade from sunlight. Patio umbrellas have also been used extensively at swimming pools and other play or recreation facilities to provide shade. Recently, hotels (and in particular, resorts) and restaurants have been major purchasers of these umbrellas.

Given the wide variety of use that patio umbrellas can be put to, it is important that an umbrella base be capable of providing adequate support to the patio umbrella. Conventional umbrella bases are made from a single piece of cast iron or cast aluminum. Most of the time, adequate support is provided in the form of sufficient weight in the base to support a heavy umbrella having a wide-spanning set of ribs that support an umbrella covering. For example, a conventional cast iron base is usually provided with a weight of about fifty pounds. Weight is an important issue for patio umbrellas, since the user must constantly determine the appropriate weight that is required to support a given patio umbrella. This determination depends on several variables, including the weight and span (i.e., expanded size) of the patio umbrella, and the location in which the patio umbrella is to be used.

For example, it is always possible to provide more weight than necessary for the base, but this is clearly undesirable because the base would be excessively heavy and difficult to move around, and because this will increase the cost if additional iron is to be used. On the other hand, if insufficient weight is provided, then the patio umbrella is susceptible to being toppled by wind or other forces (human or nature). As a further example, one might wish to provide a heavier base if the patio umbrella is to be used in an exposed outdoor area (e.g., by a swimming pool near the beach) than if the patio umbrella is to be used in a relatively sheltered or non-exposed area (e.g., indoors such as inside a large building or sheltered area). Therefore, the user must find the correct weight for the appropriate usage and environment.

In addition to addressing the concern about providing sufficient weight support, the user must also consider the portability of these bases. For example, if an umbrella base is provided having a fixed or permanent weight, this base may be suitable for use in one environment that requires less supporting weight (e.g., indoors), but cannot be used to support a patio umbrella that is to be used in an exposed outdoor area that experiences greater forces, or a heavier patio umbrella. Therefore, such an umbrella base has limited application, and the user must purchase or use different umbrella bases having different weights when different uses or patio umbrellas are desired. This is not only inconvenient, but is also expensive.

Thus, there remains a need for an umbrella base that allows the user to select the desired weight for stable support of one or more patio umbrellas, and which can be used in a wide variety of environments.

SUMMARY OF THE DISCLOSURE

It is an object of the present invention to provide an umbrella base for use in supporting a patio umbrella in which the weight of the umbrella base can be adjusted.

It is another independent object of the present invention to provide an umbrella base that can be used to support different patio umbrellas in different environments.

The objectives of the present invention are accomplished by providing a patio umbrella base having a base housing that has a central opening, and an interior wall configured to define an interior space, with a shaft extending from the central opening. A first weight is secured to the interior wall of the base housing and retained inside the interior space, and a second weight is removably secured to the base housing and retained inside the interior space.

In one embodiment of the present invention, the shaft is a first shaft that has a top end, with a second shaft provided and removably secured to the top end of the first shaft.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a novel umbrella base that allows one or more weight pieces to be added to the base, thereby allowing the user to adjust the total weight of the umbrella base. This in turn provides the user with the flexibility to use the same umbrella base (albeit with different weight pieces) for different environments, and further facilitates storage and transportation since the various weight pieces can be removed to decrease the weight of the separate pieces (base and weight pieces) that are to be moved or stored.

Figure 2:
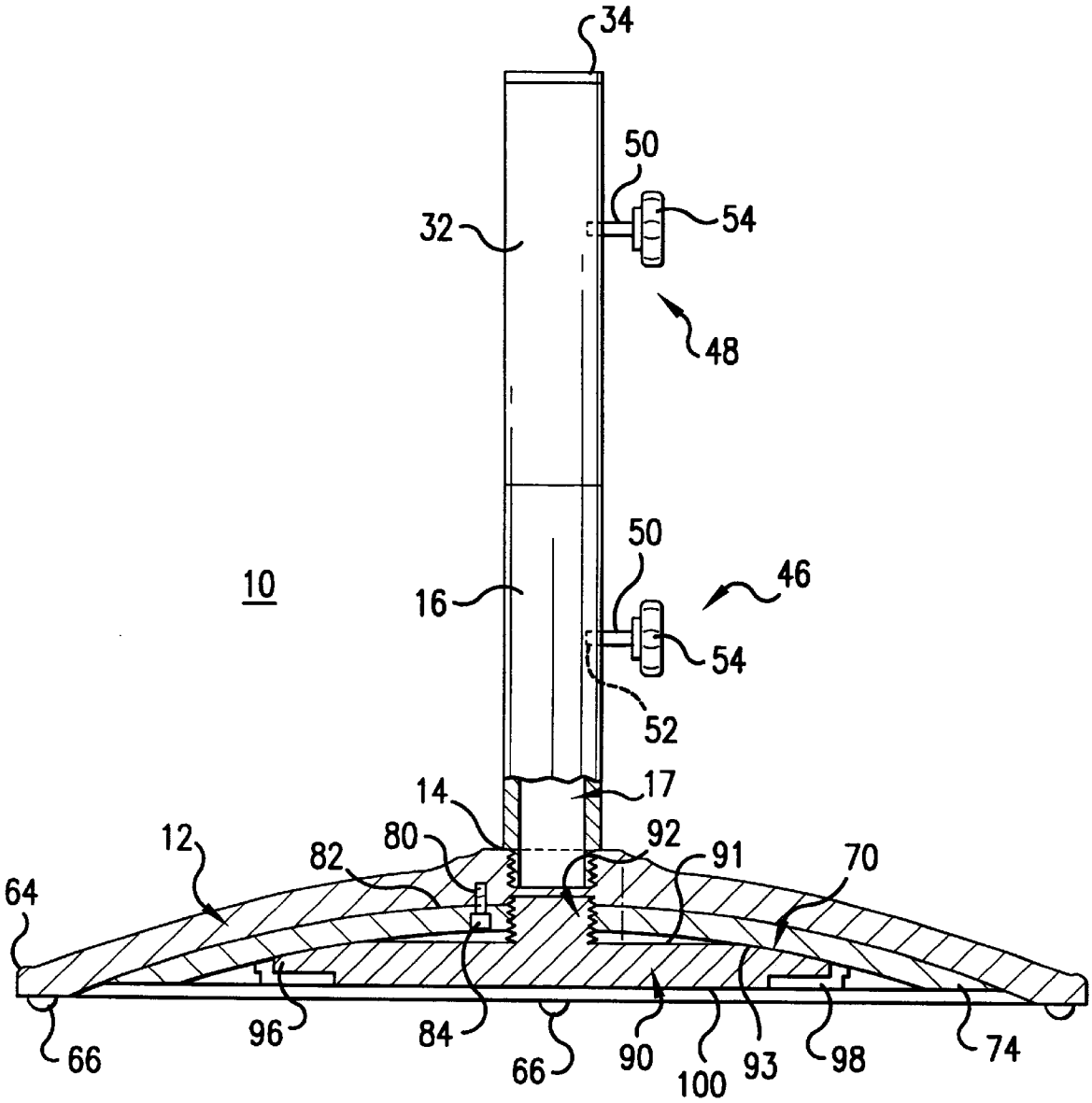
FIG. 2 is a cross-sectional view of an umbrella base according to one embodiment of the present invention.
Figure 3:
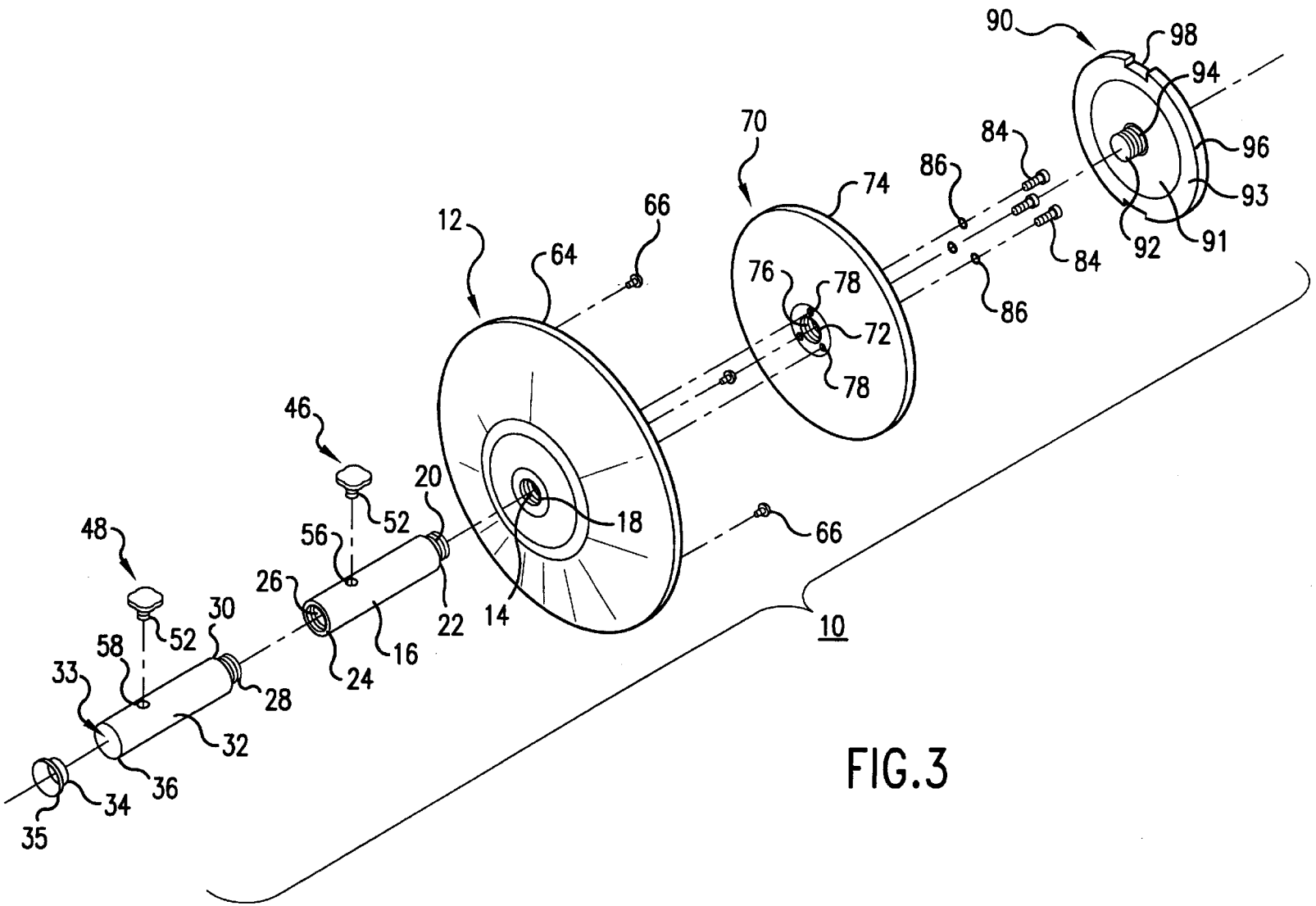
FIG. 3 is an exploded perspective view of the umbrella base of FIG. 2.

FIGS. 2 and 3 illustrate an umbrella base 10 according to one embodiment of the present invention. The umbrella base 10 has a base housing 12 having a central opening 14 from which a first cylindrical shaft 16 extends. The central opening 14 is provided with internal threads 18 that are adapted to threadably engage external threads 20 provided at the bottom 22 of the first shaft 16. The top 24 of the first shaft 16 has internal threads 26 that are adapted to threadably engage external threads 28 provided at the bottom 30 of a second cylindrical shaft 32. Thus, the bottom 22 of the first shaft 16 can be threadably connected to the central opening 14, and the bottom 30 of the second shaft 32 can be threadably connected to the top 24 of the first shaft 16. The first and second shafts 16, 32 can be made from a metal material, such as iron or aluminum. An annular ring 34 can be snap-fitted at either the top 36 of the second shaft 32, or the top 24 of the first shaft 16. The ring 34 is preferably made from plastic and has an annular lip 35 that is intended to support the pole 44 of a patio umbrella 40, and to prevent the metal material at the top 24 or 36 of the first or second shaft 16 or 32 from abrasive contact with the wood pole 44. Therefore, the plastic ring 34 acts as a buffer that protects the wood pole 44 from abrasive rubbing against the metal material of the shafts 16, 32, which can occur as the patio umbrella 40 sways from wind and other forces.

Figure 1:
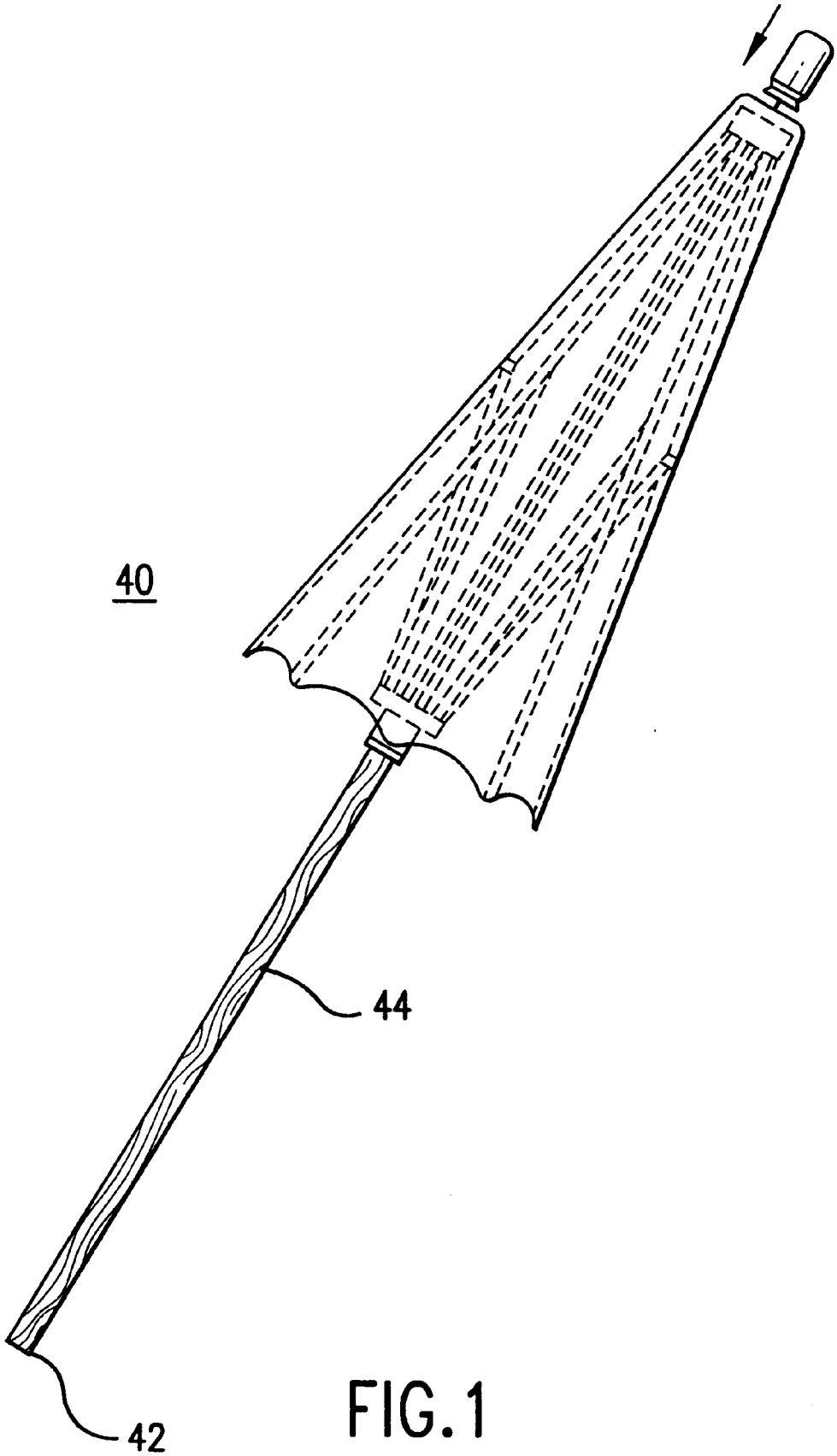
FIG. 1 is a perspective view of a conventional patio umbrella.

When the umbrella base 10 is to be used to hold and support a patio umbrella, such as a conventional patio umbrella 40 shown in FIG. 1, the bottom 42 of the pole 44 of the umbrella 40 is inserted into the shafts 16, 32. Each shaft 16 and 32 has a locking mechanism 46 and 48, respectively, that can be rotated to secure the pole 44 inside the bores 17 and 33, respectively, of the shafts 16 and 32, respectively. In a non-limiting embodiment of the present invention, each locking mechanism 46, 48 can have a pin 50 having external threads 52 provided thereon, with a grip 54 provided at an end of the pin 50. Each pin 50 is threadably screwed inside an opening 56 and 58 in each shaft 16 and 32, respectively, with the pin 50 extending inside the bores 17, 33 of the shafts 16, 32 to push the pole 44 against the inner wall of the shafts 16, 32 to secure the pole 44 inside the bores 17, 33 of the shafts 16, 32.

The base housing 12 has a dome-shaped configuration extending radially from a highest vertical elevation at the central opening 14 to the peripheral or circumferential edge 64 which is adapted to be positioned on the ground. A plurality of optional mini-bumps or rubber feet 66 can be spaced apart along the circumferential edge 64 to contact the ground, thereby raising the circumferential edge 64 slightly off the ground. The base housing 12 can be made from cast aluminum or cast iron, and would normally have a weight of about twenty pounds if it is made of cast aluminum. This weight may be sufficient on its own to support a smaller or lighter patio umbrella 40 under certain circumstances where the patio umbrella 40 is not expected to be affected by strong winds or other forces. However, in one preferred embodiment of the present invention, the base 10 further includes a first weight 70 in the form of a generally dome-shaped circular piece of cast iron. Cast iron is preferred because iron is both heavier and less expensive than cast aluminum, but it is also possible to provide the first weight 70 in the form of other weighty materials, including stone and cast aluminum, among others. The first weight 70 is also configured so that its highest vertical elevation is at its central opening 72, with the weight 70 extending radially to its peripheral or circumferential edge 74, which has the lowest vertical elevation. A plurality of threaded screw-holes 78 are provided on the first weight 70 adjacent the central opening 72, and in one embodiment, the central opening 72 can be provided with internal threads 76.

The first weight 70 is secured inside the base housing 12 by fitting the first weight 70 inside the domed interior of the base housing 12 in a manner in which the central openings 14 and 72 are aligned, and the screw-holes 78 are aligned with corresponding threaded screw-holes 80 (only one is shown in FIG. 2) in the interior wall 82 of the base housing 12. A plurality of screws 84 (one for each set of screw-holes 78 and 80) is screwed into the aligned screw-holes 78 and 80 to secure the first weight 70 inside the base housing 12, and against the interior wall 82 of the base housing 12. Corresponding washers 86 can be provided for each screw 84, if desired. In a non-limiting preferred embodiment of the present invention, where cast aluminum is used for the housing 12 and the first weight 70 is made of cast iron, the total weight of the base 10 will be about fifty pounds when the first weight 70 has been secured inside the base housing 12.

If the user desires to increase the total weight of the base 10 for use in certain environments or locations, an optional second weight 90 can be added inside the domed interior of the base housing 12. The second weight 90 is a removable weight, and can be provided in the form of a generally circular piece of cast iron. Again, cast iron is preferred for the reasons explained above, but the other materials mentioned above can also be used for the second weight 90. The second weight 90 has a central stem 92 having external threads 94, a generally horizontal surface 91 extending radially from the stem 92, and a curved sloping surface 93 extending radially from the horizontal surface 91 to a peripheral or circumferential edge 96. One or more gripping slots 98 can be provided on the bottom surface 100 of the second weight 90 adjacent the circumferential edge 96. To install the second weight 90, the user can merely insert the threaded stem 92 into the aligned central openings 14 and 72. The user then turns the second weight 90 to cause the threads 18 and 76 in the central openings 14 and 72 to engage the threads 94 on the stem 92, thereby securing the second weight 90 inside the domed interior of the base housing 12 against the first weight 70 (as shown in FIG. 2). If made of cast iron, the second weight 90 can provide an additional thirty pounds (for example) of weight, so that the entire weight of the base 10 in the preferred embodiment would be about eighty pounds, capable of supporting a patio umbrella 40 even under adverse conditions. To remove the second weight 90, the user merely turns the second weight 90 in the opposite direction to unthread the stem 92 from the central openings 14 and 72. The gripping slots 98 help the user in the installation and removal of the second weight 90 by giving the user a surface to grip during the turning motions.

Thus, the removable weights 70 and 90 give the user plenty of flexibility to provide the base 10 at different weights, thereby allowing the user to use the base 10 in different environments and locations. The second weight 90 is intended to removable, and its threaded engagement with the first weight 70 and the base housing 12 allow it to be installed and removed very quickly and conveniently. The first weight 70 is intended to accompany the base housing 12 since its screw connections are more time-consuming to remove, but the first weight 70 can still be removable, if the user so desires. These features provide the user with added convenience. For example, the user can easily remove both weights 70, 90 during transportation and storage, with the three separate pieces (base housing 12, first weight 70, and second weight 90) each being lighter in weight than any two of these pieces combined.

The provision of two separate cylindrical shafts 16 and 32 also provide the user with increased flexibility for use. For example, the double-shaft configuration allows the base 10 to be used under virtually all patio tables. In this regard, there are certain patio tables that either have a very low clearance (i.e., low table top), or include elaborate legs or other elements below the table top that make it impossible to accomodate a lengthy shaft. Therefore, the provision of the two shafts allows the upper shaft 32 to be removed, if necessary, so that the lower shaft 16 alone can be used with a table having a low clearance. As an alternative, if the patio table includes elaborate legs or other elements below the table top that might make it otherwise impossible to accomodate a lengthy shaft, the top shaft 32 can be removed from the lower shaft 16, and after the housing 12 and lower shaft 16 fitted in place under the patio table, the top shaft 32 can then be threadably connected again to the lower shaft 16.

As a further example, when the base 10 is to be used to support a patio umbrella having a standard 1.5 inch pole 44, both shafts 16, 32 can be used and the pole 44 inserted into the shafts 16, 32 and secured therein in the manner described above. However, if the base 10 is to be used to support a patio umbrella having a standard two-inch pole 44, the two shafts 16 and 32 can be removed by unscrewing them, and replacing the two shafts 16, 32 with another standard shaft (not shown) that is adapted to receive a standard two-inch pole.

While the description above refers to particular embodiments of the present invention, it will be understood that many modifications may be made without departing from the spirit thereof. The accompanying claims are intended to cover such modifications as would fall within the true scope and spirit of the present invention. As a non-limiting example, the configuration of the base housing 12, first weight 70 and second weight 90 is not critical as long as the base housing 12 defines an interior space that is large enough, and has a configuration, to securely retain the weights 70 and 90.

What is claimed is:

1. A patio umbrella base comprising:

a base housing having a central opening, and an interior wall configured to define an interior space;

a shaft extending from the central opening;

a first weight secured to the interior wall of the base housing and retained inside the interior space; and a second weight removably secured to the base housing and retained inside the interior space, the second weight enclosing the first weight inside the interior space.

2. The base of claim 1, wherein the shaft is a first shaft that has a top end, and further including a second shaft having a bottom end removably secured to the top end of the first shaft.

3. The base of claim 2, wherein the bottom end of the first shaft is threadably secured to the central opening, and wherein the bottom end of the second shaft is threadably secured to the top of the first shaft.

4. The base of claim 1, wherein the second weight is secured to the base housing and the first weight.

5. The base of claim 4, wherein the first weight has a central opening that is aligned with the central opening of the base housing, and the second weight has a central stem that is threadably secured to the central opening of the first weight.

6. The base of claim 4, wherein the first weight has a plurality of screw-holes, and the base housing has a plurality of screw-holes in the interior wall, further including a plurality of screws that are inserted through the screw-holes in the first weight and the interior wall of the base housing to secure the first weight to the base housing.

7. The base of claim 4, wherein the second weight has a bottom surface, and a gripping slot provided in the bottom surface.

8. The base of claim 1, wherein the second weight acts as a base plate covering the interior space.

9. A patio umbrella base comprising:

a base housing having a central opening, and an interior wall configured to define an interior space;

a shaft extending from the central opening;

a first weight removably secured to the interior wall of the base housing and retained inside the interior space; and a second weight removably secured to the base housing and retained inside the interior space.

* * * * *